US009858885B2

(12) United States Patent
Li et al.

(10) Patent No.: US 9,858,885 B2
(45) Date of Patent: Jan. 2, 2018

(54) METHOD AND DEVICE FOR REDUCING DISPLAY BRIGHTNESS

(71) Applicant: Xiaomi Inc., Beijing (CN)

(72) Inventors: Guosheng Li, Beijing (CN); Anyu Liu, Beijing (CN); Yuan Zhang, Beijing (CN)

(73) Assignee: Xiaomi Inc., Beijing (CN)

( * ) Notice: Subject to any disclaimer, the term of this patent is extended or adjusted under 35 U.S.C. 154(b) by 0 days.

(21) Appl. No.: 15/082,847

(22) Filed: Mar. 28, 2016

(65) Prior Publication Data

US 2017/0047035 A1 Feb. 16, 2017

(30) Foreign Application Priority Data

Aug. 13, 2015 (CN) ..... 2015 1 0498535

(51) Int. Cl.
*G09G 3/36* (2006.01)
*G09G 3/20* (2006.01)

(52) U.S. Cl.
CPC ..... *G09G 3/3688* (2013.01); *G09G 3/2007* (2013.01); *G09G 3/3696* (2013.01);
(Continued)

(58) Field of Classification Search
CPC ..... G09G 2310/027; G09G 2310/0272; G09G 2310/0275; G09G 2310/0278;
(Continued)

(56) References Cited

U.S. PATENT DOCUMENTS 8,199,091 B2 6/2012 Ker et al.
2005/0264550 A1* 12/2005 Ohshima ..... G09G 3/3233 345/204

(Continued)

FOREIGN PATENT DOCUMENTS

CN 101191926 A 6/2008
CN 101211035 A 7/2008

(Continued)

OTHER PUBLICATIONS

International Search Report dated May 23, 2016 in PCT/CN2015/099014 (with English translation of categories of cited documents).

(Continued)

*Primary Examiner* — Grant Sitta
(74) *Attorney, Agent, or Firm* — Oblon, McClelland, Maier & Neustadt, L.L.P.

(57) ABSTRACT

The present disclosure discloses a method and device for reducing display brightness, and belongs to the technical field of display. Aspects of the disclosure provide a method for reducing display brightness. The method includes acquiring a first corresponding relationship between pixel values and voltages for reducing display brightness. The first corresponding relationship is determined based on a second corresponding relationship between pixel values and voltages and a ratio for brightness reduction. Further, the method includes determining a voltage corresponding to a pixel value of a pixel to be displayed based on the first corresponding relationship and at a scanning moment corresponding to the pixel, outputting the determined voltage to a data line corresponding to the pixel in a liquid crystal display screen.

12 Claims, 4 Drawing Sheets

(52) U.S. Cl.
CPC ..... *G09G 2320/0626* (2013.01); *G09G 2320/0673* (2013.01); *G09G 2360/144* (2013.01)

(58) Field of Classification Search
CPC ..... G09G 2310/0297; G09G 3/20; G09G 3/2003; G09G 3/2007; G09G 3/2011; G09G 3/2014; G09G 3/2018; G09G 3/2022; G09G 3/2025; G09G 3/2029; G09G 3/00; G09G 2300/0413; G09G 2300/0439; G09G 2300/0443; G09G 2300/0447; G09G 2300/0452; G09G 2300/0456; G09G 2300/046; G09G 2300/0465; G09G 2300/0469; G09G 2300/0473; G09G 2300/0478; G09G 2300/0482
USPC ..... 345/690, 204
See application file for complete search history.

(56) References Cited

U.S. PATENT DOCUMENTS

| | | | | |
|---|---|---|---|---|
| 2007/0229435 | A1* | 10/2007 | Lee | G09G 3/2011 345/98 |
| 2008/0165116 | A1* | 7/2008 | Herz | G09G 3/3406 345/102 |
| 2008/0165203 | A1* | 7/2008 | Pantfoerder | G09G 3/20 345/589 |
| 2008/0204384 | A1 | 8/2008 | Lee et al. | |
| 2009/0160747 | A1* | 6/2009 | Morisue | G09G 3/3406 345/88 |
| 2009/0267973 | A1 | 10/2009 | Lee | |
| 2009/0304279 | A1* | 12/2009 | Mori | G06T 5/009 382/169 |
| 2010/0097306 | A1 | 4/2010 | Ker et al. | |
| 2010/0120471 | A1* | 5/2010 | Uchikawa | G09G 3/3406 455/566 |
| 2010/0201887 | A1 | 8/2010 | Bakhmutsky | |
| 2013/0249955 | A1 | 9/2013 | Kim et al. | |
| 2014/0055505 | A1* | 2/2014 | Ikeda | G09G 3/22 345/690 |
| 2014/0063075 | A1* | 3/2014 | Kim | G09G 3/3406 345/690 |
| 2015/0070337 | A1* | 3/2015 | Bell | G09G 3/2003 345/207 |
| 2015/0070406 | A1 | 3/2015 | Baek et al. | |
| 2016/0358530 | A1* | 12/2016 | Schuch | G09G 3/20 |

FOREIGN PATENT DOCUMENTS

| | | | |
|---|---|---|---|
| CN | 101226727 | A | 7/2008 |
| CN | 101251985 | A | 8/2008 |
| CN | 101650923 | A | 2/2010 |
| CN | 202796008 | U | 3/2013 |
| CN | 103871377 | A | 6/2014 |
| CN | 104700786 | A | 6/2015 |
| CN | 105070252 | A | 11/2015 |
| JP | 2005-181731 | | 7/2005 |
| JP | 2006-003874 | | 1/2006 |
| JP | 2009-109761 | | 5/2009 |
| RU | 2470381 | C2 | 12/2012 |
| WO | WO 2008-117784 | A1 | 10/2008 |

OTHER PUBLICATIONS

Written Opinion of the international Searching Authority dated May 23, 2016 in PCT/CN2015/099014.
Chinese Office Action dated Jan. 23, 2017 in Patent Application No. 201510498535.0 (with partial English translation).
Extended European Search Report dated Jan. 4, 2017 in Patent Application No. 16159106.0.
Japanese Office Action dated Sep. 1, 2017 in Japanese Application No. 2016-543231 (3 pages).
Russian Office Action dated Oct. 27, 2017 in Russian Application No. 2016120203 (2 pages).

* cited by examiner

METHOD AND DEVICE FOR REDUCING DISPLAY BRIGHTNESS

CROSS-REFERENCE TO RELATED APPLICATIONS

This application is filed based upon and claims priority to Chinese Patent Application No. 201510498535.0, filed on Aug. 13, 2015, the entire contents of which are incorporated herein by reference.

TECHNICAL FIELD

The present disclosure generally relates to the field of display, and more particularly, to a method and device for reducing display brightness.

BACKGROUND

Mobile terminals, such as smart phones and tablet computers are widely used.

When a mobile terminal is used at night, a display content of the mobile terminal may be glaring because of dark ambient light. Display brightness of a liquid crystal display screen may be reduced by regulating brightness of a backlight. However, in case of very dark ambient light, the display content of the liquid crystal display screen may still be glaring even though the brightness of the backlight is maximally reduced.

SUMMARY

Aspects of the disclosure provide a method for reducing display brightness. The method includes acquiring a first corresponding relationship between pixel values and voltages for reducing display brightness. The first corresponding relationship is determined based on a second corresponding relationship between pixel values and voltages and a ratio for brightness reduction. Further, the method includes determining a voltage corresponding to a pixel value of a pixel to be displayed based on the first corresponding relationship and at a scanning moment corresponding to the pixel, outputting the determined voltage to a data line corresponding to the pixel in a liquid crystal display screen.

According to an aspect of the disclosure, the method includes storing a plurality of first corresponding relationships respectively for a plurality of night display levels. The plurality of first corresponding relationships are determined based on the second corresponding relationship and ratios corresponding to the plurality of night display levels. In an example, the method includes detecting an ambient light intensity, determining a night display level based on the ambient light intensity and selecting the first corresponding relationship from the plurality of first corresponding relationship based on the night display level. Further, the method includes determining the first corresponding relationship of the pixel values and voltages according to the second corresponding relationship and the ratio. To determine the first corresponding relationship of the pixel values and voltages according to the second corresponding relationship and the ratio, in an example, the method includes multiplying a maximum pixel value $N_{max}$ by the ratio to obtain a target pixel value $N_x$, determining a target voltage corresponding to the target pixel value $N_x$ according to the second corresponding relationship, corresponding the target voltage $V_{max}$ to the maximum pixel value $N_{max}$ in the first corresponding relationship, determining a brightness value $B_{max}$ corresponding to the target voltage $V_{max}$ according to a brightness-voltage relationship, calculating a brightness value $B_n$ corresponding to a pixel value N according to a formula:

(N/Nmax)gamma value=Bn/Bmax, determining a voltage $V_n$ corresponding to the brightness value $B_n$ according to the brightness-voltage relationship and corresponding the voltage $V_n$ to the pixel value N in the first corresponding relationship. In an example, the gamma value is in a range from 1.8 to 2.5.

Aspects of the disclosure provide a device for reducing display brightness. The device includes a processor, and a memory configured to store executable instructions of the processor, and store a first corresponding relationship between pixel values and voltages for reducing display brightness. The first corresponding relationship is determined based on a second corresponding relationship between pixel values and voltages and a ratio for brightness reduction. The processor is configured to determine a voltage corresponding to a pixel value of a pixel to be displayed based on the first corresponding relationship and at a scanning moment corresponding to the pixel, output the determined voltage to a data line corresponding to the pixel in a liquid crystal display screen.

According to an aspect of the disclosure, the memory is configured to store a plurality of first corresponding relationships respectively for a plurality of night display levels. The plurality of first corresponding relationships are determined based on the second corresponding relationship and ratios corresponding to the plurality of night display levels. In an example, the processor is configured to detect an ambient light intensity, determine a night display level based on the ambient light intensity, and select the first corresponding relationship from the plurality of first corresponding relationship based on the night display level. In an example, the processor is configured to determine the first corresponding relationship of the pixel values and voltages according to the second corresponding relationship and the ratio. For example, the processor is configured to multiply a maximum pixel value $N_{max}$ by the ratio to obtain a target pixel value $N_x$, determine a target voltage corresponding to the target pixel value $N_x$ according to the second corresponding relationship, correspond the target voltage $V_{max}$ to the maximum pixel value $N_{max}$ in the first corresponding relationship, determine a brightness value $B_{max}$ corresponding to the target voltage $V_{max}$ according to a brightness-voltage relationship, calculate a brightness value $B_n$ corresponding to a pixel value N according to a formula:

(N/Nmax)gamma value=Bn/Bmax, determine a voltage $V_n$ corresponding to the brightness value $B_n$ according to the brightness-voltage relationship, and correspond the voltage $V_n$ to the pixel value N in the first corresponding relationship.

Aspects of the disclosure provide a non-transitory computer-readable storage medium having stored therein instructions that, when executed by a processor of a mobile terminal, causes the mobile terminal to perform operations for reducing display brightness. The operations include reading, from a memory, a first corresponding relationship between pixel values and voltages for reducing display brightness. The first corresponding relationship is determined based on a second corresponding relationship between pixel values and voltages and a ratio and stored in the memory. Further, the operations include determining a voltage corresponding to a pixel value of a pixel to be displayed based on the first corresponding relationship, and at a scanning moment corresponding to the pixel, outputting the determined voltage to a data line corresponding to the pixel in a liquid crystal display screen.

It should be understood that the above general description and detailed description below are only exemplary and explanatory and not intended to limit the present disclosure.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Figure 1:
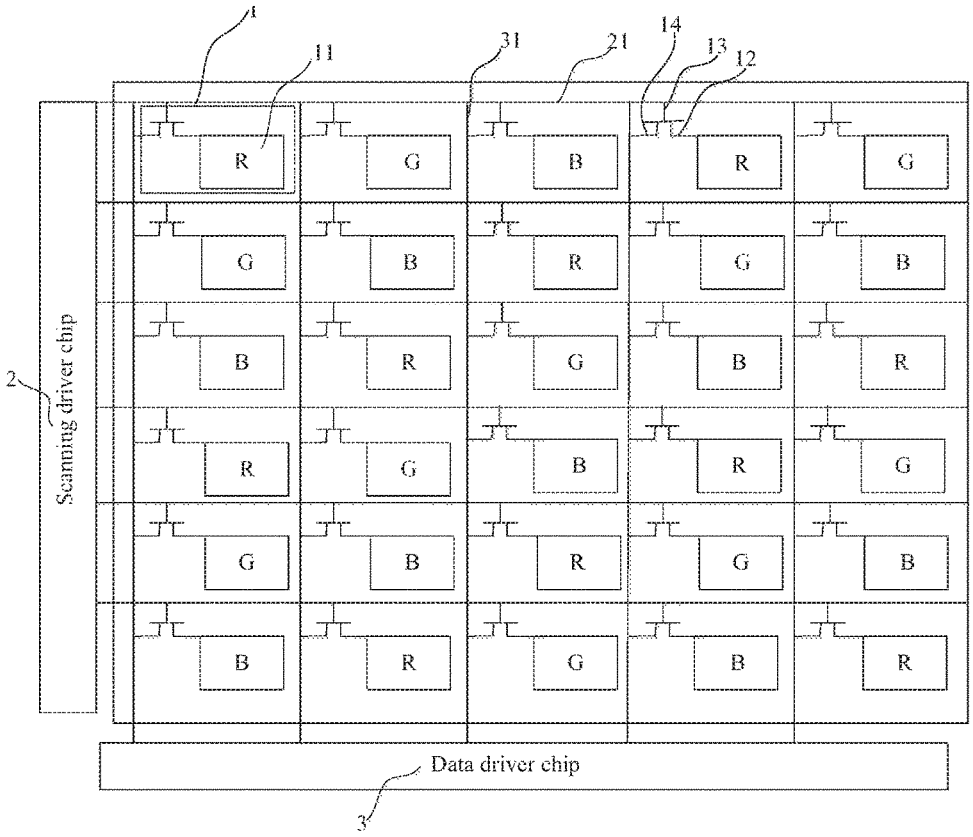
FIG. 1 is a structure diagram of an array substrate on a Thin Film Transistor Liquid Crystal Display (TFT-LCD), according to an embodiment.

The schematic embodiments are described here in detail, and examples are shown in the drawings. Unless specified otherwise, the same numbers in different drawings represent the same or similar elements. Implementations described in the following schematic embodiments do not represent all implementations consistent with the present disclosure. On the contrary, they are only examples of apparatus and methods consistent with some aspects of the present disclosure in the attached claims.

If a mobile terminal is in a normal display mode, when a user is in an environment with an extremely low light intensity value, the mobile terminal may reduce brightness of a screen by reducing a grayscale voltage of a corresponding liquid crystal unit in the liquid crystal display screen, thereby achieving brightness suitable for eyes to watch.

The present disclosure is described by taking a mobile terminal as an example. The mobile terminal at least includes a liquid crystal display screen, and the liquid crystal display screen includes a backlight, TFT switching elements, liquid crystal units and the like. The liquid crystal display screen is configured to display an output content of the mobile terminal; the backlight is configured to control brightness of the liquid crystal display screen; and the TFT switching element is configured to control gray-scale voltages of the corresponding liquid crystal units in the liquid crystal display screen.

The grayscale voltages in the liquid crystal display screen refer to drain voltages, connected with data lines in a data driver chip, of each liquid crystal unit.

FIG. 1 is a structure diagram of an array substrate on a TFT-LCD, according to an embodiment. The array substrate includes m*n liquid crystal units 1, a scanning driver chip 2, m scanning lines 21, a data driver chip 3 and n data lines 31.

The liquid crystal units 1 are arranged to form an array with m rows and n columns. Each liquid crystal unit 1 includes; a liquid crystal pixel electrode 11 and a TFT switching element. Each TFT switching element includes a source 12, a gate 13 and a drain 14. The liquid crystal pixel electrodes 11 are connected with the sources 12 in the TFT switching elements. The liquid crystal pixel electrodes 11 may be red liquid crystal pixel electrodes R, green liquid crystal pixel electrodes G or blue liquid crystal pixel electrodes B.

The scanning driver chip 2 includes m scanning pins, and each scanning pin is connected with one scanning line 21. The liquid crystal units 1 of each row correspond to one scanning line 21, and the scanning lines 21 are connected with the drains 13 in the liquid crystal units 1 of the corresponding rows.

The data driver chip 3 includes n data pins, and each data pin is connected with one data line 31. The liquid crystal units 1 of each column correspond to one data line 31, and the data lines 31 are connected with the drains 14 of the liquid crystal units 1 of the corresponding columns.

When the array substrate operates, the data lines 31 are configured to transmit video data signals in the data driver chip 3 to the drains 14 of the TFT switching elements so as to control voltages of the liquid crystal pixel electrodes 11.

When the liquid crystal display screen works, for a frame of picture, pixels in the picture correspond to the liquid crystal units 1 in the liquid crystal display screen. Each pixel has its own grayscale pixel value, for example, the first pixel has a gray-scale pixel value of 244 and the second pixel has a grayscale pixel value of 243, and a value range of each grayscale pixel value is [0, 255].

Taking a pixel as an example, the liquid crystal unit 1 corresponding to each pixel has a corresponding scanning line 21 and a data line 31 in a liquid crystal driver circuit. The scanning driver chip 2 controls the scanning lines 21 to be connected row by row, and when the scanning line 21 corresponding to the pixel is connected, the data driver chip 3 outputs a grayscale voltage corresponding to the pixel to the data line 31 corresponding to the pixel, and stores the corresponding grayscale voltage to the liquid crystal pixel electrode 11 in the liquid crystal unit 1 corresponding to the pixel. The grayscale voltage is obtained by querying a preset gamma curve, and the gamma curve is a corresponding relationship between a grayscale pixel value and a grayscale voltage.

For an 8-bit panel, it represents grayscale pixel values 0-255 (256 in total), each grayscale pixel value in the grayscale pixel values 0-255 corresponds to a grayscale voltage. Taking each grayscale pixel value and the grayscale voltage corresponding to the grayscale pixel value as a point, then 256 points should be obtained, and the 256 points are drawn into a curve, i.e. a gamma curve.

The present disclosure provides a transformed gamma curve, and the transformed gamma curve is calculated according to a preset ratio and an initial gamma curve. The transformed gamma curve may reduce overall brightness of a liquid crystal display panel, thereby realizing low-brightness display of the liquid crystal display panel. Reference will now be made to the following embodiment.

Figure 2:
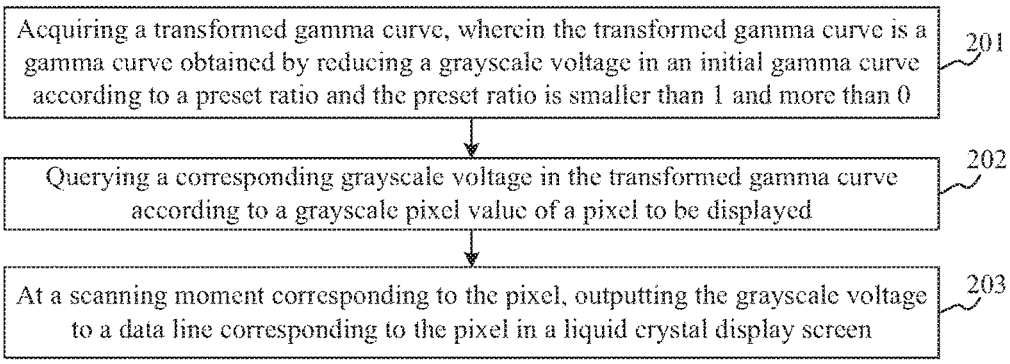
FIG. 2 is a flow chart of a method for reducing display brightness, according to an exemplary embodiment.

FIG. 2 is a flow chart of a method for reducing display brightness, according to an exemplary embodiment. In this embodiment, the method for reducing the display brightness is applied to a mobile terminal including a liquid crystal display screen. The method for reducing the display brightness may include the following steps:

Step 201: acquiring a transformed gamma curve, wherein the transformed gamma curve is a gamma curve obtained by reducing a grayscale voltage in an initial gamma curve according to a preset ratio and the preset ratio is smaller than 1 and more than 0;

Step 202: querying a corresponding grayscale voltage in the transformed gamma curve according to a grayscale pixel value of a pixel to be displayed; and Step 203: at a scanning moment corresponding to the pixel, outputting the grayscale voltage to a data line corresponding to the pixel in a liquid crystal display screens.

According to the method for reducing the display brightness, the transformed gamma curve is acquired, the corresponding grayscale voltage in the transformed gamma curve is queried according to the gray scale pixel value of the pixel to be displayed, and the queried grayscale voltage is output to the data line corresponding to the pixel in the liquid crystal display screen at the scanning moment corresponding to the pixel, so that the problem of incapability in meeting a requirement on ambient light by regulating brightness of a backlight or a background color of a UI in case of extremely dark ambient light is solved, and the effect of reducing the brightness of the screen by reducing the grayscale voltage of the pixel in the liquid crystal display screen in case of extremely dark ambient light is achieved.

Figure 3:
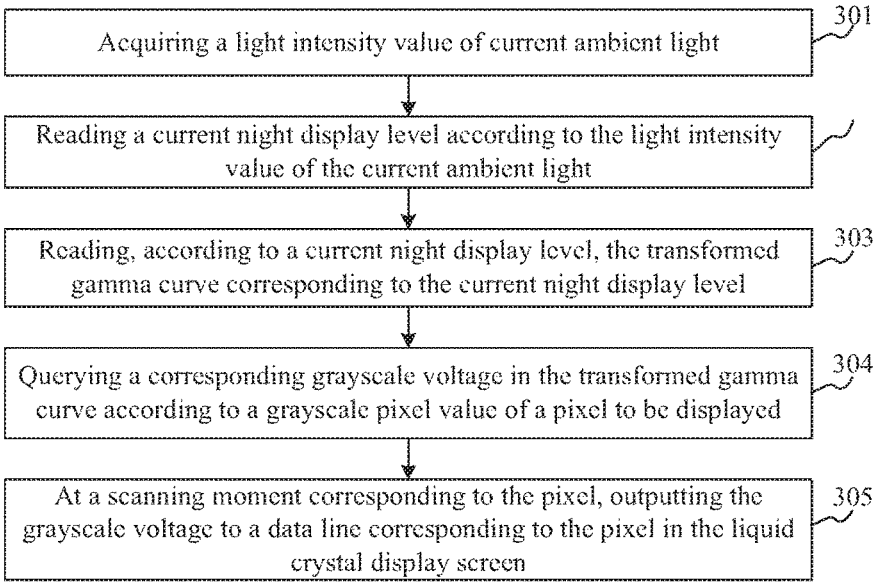
FIG. 3 is a flow chart of another method for reducing display brightness, according to an exemplary embodiment.

FIG. 3 is a flow chart of another method for reducing display brightness, according to an exemplary embodiment. In this embodiment, the method for reducing the display brightness is applied to a mobile terminal including a liquid crystal display screen. The method for reducing the display brightness may include the following steps:

Step 301: acquiring a light intensity value of current ambient light.

The light intensity value of the current ambient light refers to light intensity of the current ambient light.

Alternatively, the mobile terminal acquires the light intensity value of the current ambient light via a built-in light intensity sensor; and In this embodiment, an acquisition manner for the light intensity value of the ambient light will not be limited.

Step 302: reading a current night display level according to the light intensity value of the current ambient light.

Different light intensity values of the ambient light correspond to different night display levels. If the light intensity value of the ambient light is 0-50 lx, the terminal is in a night display mode, wherein lx is unit of light intensity. The light intensity values of the ambient light are divided in to 5 intervals, with every 10 forming an interval, and the intervals of the light intensity values of the ambient light correspond to night display levels. For example, a corresponding relationship between a light intensity value and a night display level is shown in Table 1:

TABLE 1

| Interval of light intensity value | Night display level |
|---|---|
| (40-50) | Level 1 |
| (30-40) | Level 2 |
| (20-30) | Level 3 |
| (10-20) | Level 4 |
| (0-10) | Level 5 |

If the light intensity value of the current ambient light is 25, it can be seen from the corresponding relationship in Table 1 that the night display level of the mobile terminal is at level 3. When the brightness of the ambient light is lower, the night display level will be higher.

Step 303: reading, according to a current night display level, the transformed gamma curve corresponding to the current night display level.

Different night display levels correspond to different transformed gamma curves, and different transformed gamma curves correspond to different preset ratios.

The mobile terminal is pre-stored with a plurality of transformed gamma curves, and each gamma curve corresponds to a night display level.

Since each transformed gamma curve is obtained by transforming an initial gamma curve according to a preset ratio, different transformed gamma curves correspond to their own preset ratios.

There is a corresponding relationship between a night display level and a preset ratio of a transformed gamma curve. When the liquid crystal display level is higher, the preset ratio of the transformed gamma curve corresponding to the liquid crystal display level will be lower.

For example, the corresponding relationship between the night display level and the preset ratio is shown in the following table:

TABLE 2

| Night display level | Preset ratio |
|---|---|
| Level 1 | 85% |
| Level 2 | 75% |
| Level 3 | 65% |
| Level 4 | 55% |
| Level 5 | 45% |

According to the corresponding relationship in Table 2, the transformed gamma curve corresponding to level 1 is obtained by transforming the initial gamma curve according to the ratio of 85%; the transformed gamma curve corresponding to level 2 is obtained by transforming the initial gamma curve according to the ratio of 75%; the transformed gamma curve corresponding to level 3 is obtained by transforming the initial gamma curve according to the ratio of 65%; the transformed gamma curve corresponding to level 4 is obtained by transforming the initial gamma curve according to the ratio of 55%; and the transformed gamma curve corresponding to level 1 is obtained by transforming the initial gamma curve according to the ratio of 45%.

The mobile terminal determines, according to the current night display level, the gamma curve currently required to be used should be the transformed gamma curve corresponding to the current night display level.

For example, if the current night display level is level 2, the mobile terminal determines that the transformed gamma curve corresponding to level 2 should be the gamma curve currently required to be used. The gamma curve is obtained by transforming the initial gamma curve according to the ratio of 75%.

In this embodiment, the relationship between the light intensity value of the ambient light and the corresponding night display level in Table 1 and the relationship between the night display level and the preset ratio in Table 2 are only provided for illustrative purposes, and no special limits should be imposed on the two relationships in this embodiment.

Step 304: querying a corresponding grayscale voltage in the transformed gamma curve according to a grayscale pixel value of a pixel to be displayed.

When a frame of image is displayed, for each pixel to be displayed in the image, there is a corresponding grayscale pixel value.

The mobile terminal queries the grayscale voltage corresponding to the grayscale pixel value of the pixel to be displayed according to the transformed gamma curve.

Step 305: at a scanning moment corresponding to the pixel, outputting the grayscale voltage to a data line corresponding to the pixel in the liquid crystal display screen.

For a liquid crystal unit corresponding to each pixel, there is a scanning line and a data line in a liquid crystal driver circuit.

When the pixel is displayed, the liquid crystal driver circuit sends a scanning signal to the scanning line corresponding to the pixel, and simultaneously inputs the grayscale voltage corresponding to the pixel to the data line corresponding to the pixel, such that the pixel will have a display brightness corresponding to the grayscale voltage.

The grayscale voltage is a voltage reduced relative to an initial grayscale voltage, so that the display brightness of the liquid crystal display screen is reduced.

It should be appreciated that the transformed gamma curve is pre-stored in a memory, and it may be accessed by the mobile terminal. Meanwhile, the relationship between the light intensity value of the ambient light and the night display level and the relationship between the night display level and the preset ratio are also be preset, and no special limits should be imposed on the two relationships in this embodiment, and they may be autonomously set by those skilled in the art.

In view of the above, according to the method for reducing the display brightness in this embodiment, the light intensity value of the current ambient light is acquired, the current night display level is read according to the light intensity value of the current ambient light, the transformed gamma curve corresponding to the night display level is read according to the current night display level, the corresponding grayscale voltage in the transformed gamma curve is queried, and the queried grayscale voltage is output to the data line corresponding to the pixel in the liquid crystal display screen at the scanning moment corresponding to the pixel, so that the problem of incapability in meeting a requirement on the ambient light by regulating brightness of a backlight or a background color of a UI in case of extremely dark ambient light is solved, and the effect of reducing the brightness of the screen by reducing the grayscale voltage of the pixel in the liquid crystal display screen in case of extremely dark ambient light is achieved.

Figure 4:
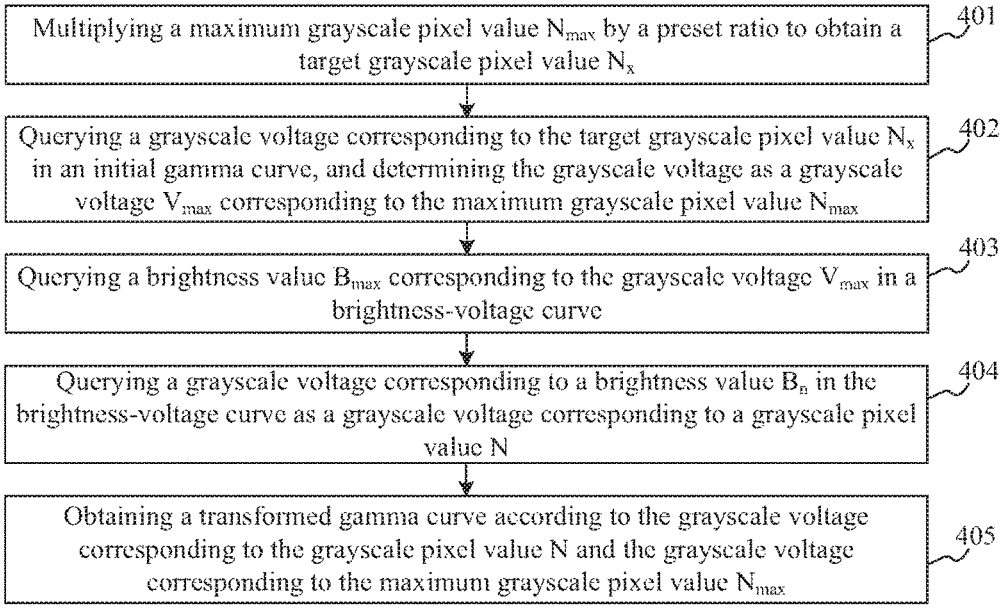
FIG. 4 is a flow chart of calculating a transformed gamma curve, according to an exemplary embodiment.

The embodiments shown in FIGS. 2-3 involve acquisition of the transformed gamma curve pre-stored in the memory. The transformed gamma curve may be obtained by transformation according to the initial gamma curve and the preset ratio. As shown in FIG. 4, a transformation process includes:

Step 401: multiplying a maximum gray-scale pixel value $N_{max}$ by the preset ratio to obtain a target grayscale pixel value $N_x$.

For example, the maximum grayscale pixel value is 255, the preset ratio is 85%, and then the target grayscale pixel value 216 is obtained by 255*85%.

Alternatively, in this embodiment, if a numerical value obtained by multiplication of the maximum gray-scale pixel value and the preset ratio is not an integer, an integer is obtained by rounding up or rounding down, and is determined as the target grayscale pixel value.

Step 402: querying a gray-scale voltage corresponding to the target grayscale pixel value $N_x$ in the initial gamma curve, and determining the grayscale voltage as a grayscale voltage $V_{max}$ corresponding to the maximum grayscale pixel value $N_{max}$.

The grayscale voltage corresponding to the target grayscale pixel value is queried in the initial gamma curve according to the obtained target grayscale pixel value, the queried grayscale voltage corresponding to the target grayscale pixel value is determined as the grayscale voltage corresponding to the maximum gray-scale pixel value, and then brightness corresponding to the maximum grayscale pixel value is converted into the preset ratio of original brightness.

For example, the maximum grayscale pixel value is 255, the preset ratio is 85%, and then the target grayscale pixel value 216 is obtained by rounding down according to 255*85%=216.75. An initial grayscale voltage 5v corresponding to the maximum grayscale pixel value 255 may be queried in the initial gamma curve, the grayscale voltage 4.7v corresponding to the target grayscale pixel value 216, and then the grayscale voltage 4.7v corresponding to the target grayscale pixel value 216 is determined as a new transformed gray-scale voltage corresponding to the maximum grayscale pixel value 216. That is, the grayscale voltage corresponding to the maximum grayscale pixel value 255 is reduced from original 5v to transformed 4.7v.

Step 403: querying a brightness value $B_{max}$ corresponding to the grayscale voltage $V_{max}$ in a brightness-voltage curve.

The brightness-voltage curve includes a corresponding relationship between brightness and a grayscale voltage. For the same liquid crystal display screen, the brightness-voltage curve is constant, and for example, 1,024 gray-scale voltages correspond to 1,024 brightness values.

The maximum brightness value $B_{max}$ corresponding to the grayscale voltage $V_{max}$, i.e., the brightness value corresponding to 4.7v, is queried in the brightness-voltage curve.

Each brightness value $B_n$ corresponding to another grayscale pixel value N is measured according to the queried maximum brightness value $B_{max}$ and the following formula:

$$(N/N\text{max})\text{gamma value}=Bn/B\text{max}.$$

It is noted that the gamma value can be any suitable value. For example, the gamma value can be a value in a range from 1.8 to 2.5. In an example, the gamma value is 2.2, and a value range of N is $[0, N_{max})$. For example, N may be 0, 1, 2, 3, 4, 5, 6 and up to 255.

Step 404: querying a grayscale voltage corresponding to the brightness value $B_n$ in the brightness-voltage curve as a grayscale voltage corresponding to the gray-scale pixel value N.

A grayscale voltage corresponding to each brightness value $B_n$, i.e. the grayscale voltage corresponding to the grayscale pixel value N, is queried in the brightness-voltage curve according to each measured brightness value $B_n$ corresponding to the grayscale pixel value N.

Step 405: obtaining the transformed gamma curve according to the grayscale voltage corresponding to the grayscale pixel value N and the grayscale voltage corresponding to the maximum gray-scale pixel value $N_{max}$.

By the abovementioned process, the grayscale voltages corresponding to the grayscale pixel values 0-255 may be calculated, and the transformed gamma curve may be obtained according to the grayscale voltages corresponding to these grayscale pixel values 0-255.

Alternatively, the abovementioned process may be carried out by the mobile terminal, and may also be carried out by an external device and then stored in the mobile terminal. In the present disclosure, the entity for carrying out the abovementioned process will not be limited.

It should be appreciated that, other than reducing the grayscale voltage corresponding to the grayscale pixel value, reducing the display brightness according to the present disclosure may further include, for example, maximally reducing the brightness of the backlight, changing the background color of the UI into black or another dark color. Under the condition that the requirement on the current ambient light still cannot be met when the brightness of the backlight is maximally reduced, the embodiment may further reduce the display brightness.

A device embodiment of the present disclosure is described below, and may be configured to execute the method embodiment of the present disclosure. Undisclosed details in the device embodiment of the present disclosure may refer to the method embodiment of the present disclosure.

Figure 5:
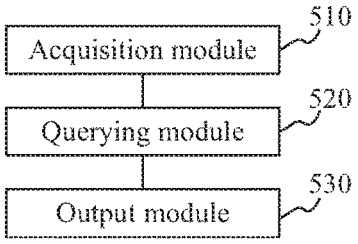
FIG. 5 is a block diagram of a device for reducing display brightness, according to an exemplary embodiment.

FIG. 5 is a block diagram of a device for reducing display brightness, according to an exemplary embodiment. In this embodiment, the device for reducing the display brightness may be applied to a mobile terminal including a liquid crystal display screen. The device for reducing the display brightness may include:

an acquisition module 510 configured to acquire a transformed gamma curve, wherein the transformed gamma curve is a gamma curve obtained by reducing a grayscale voltage in an initial gamma curve according to a preset ratio and the preset ratio is smaller than 1 and more than 0;

a querying module 520 configured to query a corresponding grayscale voltage in the transformed gamma curve according to a grayscale pixel value of a pixel to be displayed; and an output module 530 configured to, at a scanning moment corresponding to the pixel, output the grayscale voltage to a data line corresponding to the pixel in a liquid crystal display screen.

In view of the above, according to the device for reducing the display brightness provided in this embodiment, the transformed gamma curve is acquired, the corresponding gray-scale voltage in the transformed gamma curve is queried according to the grayscale pixel value of the pixel to be displayed, and the queried grayscale voltage is output to the data line corresponding to the pixel in the liquid crystal display screen at the scanning moment corresponding to the pixel, so that the problem of incapability in meeting a requirement on ambient light by regulating brightness of a backlight or a background color of a UI in case of extremely dark ambient light is solved, and the effect of reducing the brightness of the screen by reducing the grayscale voltage of the pixel in the liquid crystal display screen in case of extremely dark ambient light is achieved.

Figure 6A:
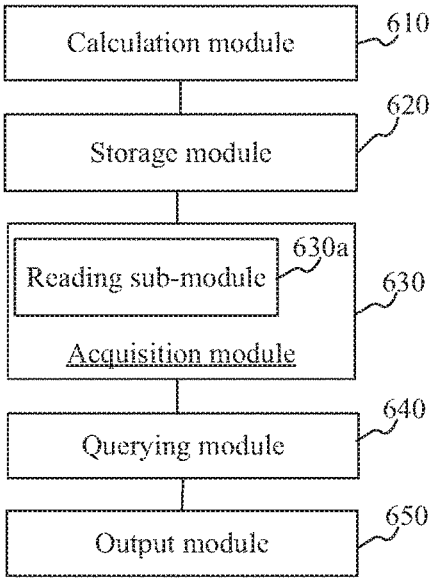
FIG. 6A is a block diagram of another device for reducing display brightness, according to an exemplary embodiment.
Figure 6B:
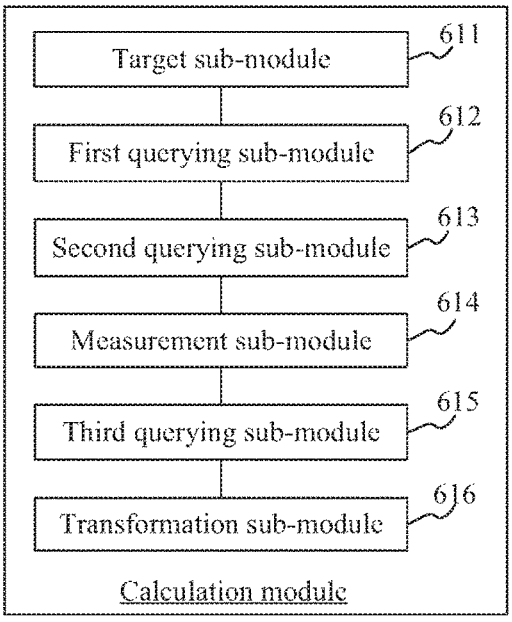
FIG. 6B is a block diagram of a calculation module, according to an exemplary embodiment.

FIG. 6A is a block diagram of another device for reducing display brightness, according to an exemplary embodiment. In this embodiment, the device for reducing the display brightness may be applied to a mobile terminal including a liquid crystal display screen, for example. The device for reducing the display brightness may include:

a calculation module 610, configured to calculate a transformed gamma curve according to an initial gamma curve and a preset ratio, wherein the module may, as shown in FIG. 6B, include the following module:

a target sub-module 611, configured to multiply a maximum grayscale pixel value $N_{max}$ by the preset ratio to obtain a target grayscale pixel value $N_x$, wherein Alternatively, if the target grayscale pixel value obtained by multiplication of the maximum grayscale pixel value and the preset ratio is not an integer, the target gray-scale pixel value may be rounded up or rounded down in the embodiment;

Alternatively, in order to obtain different brightness levels, the preset ratio may optionally be 85% or 75% or 70%, and a value of the preset ratio is not limited, and may be set according to a requirement of a user in the embodiment;

a first querying sub-module 612, configured to query a grayscale voltage corresponding to the target grayscale pixel value $N_x$ in an initial gamma curve, and determine the grayscale voltage as a grayscale voltage $V_{max}$ corresponding to the maximum grayscale pixel value $N_{max}$;

a second querying sub-module 613, configured to query a brightness value $B_{max}$ corresponding to the grayscale voltage $V_{max}$ in a brightness-voltage curve.

The brightness-voltage curve includes a corresponding relationship between brightness and a grayscale voltage;

a measurement sub-module 614, configured to measure a brightness value $B_n$ corresponding to a grayscale pixel value N according to the following formula:

$$(N/N\text{max})^{\text{gamma value}}=Bn/B\text{max}$$

wherein

Alternatively, the gamma value is 2.2 and a value range of N is $[0, N_{max})$;

a third querying sub-module 615, configured to query a grayscale voltage corresponding to the brightness value $B_n$ in the brightness-voltage curve as a grayscale voltage corresponding to the grayscale pixel value N;

a transformation sub-module 616, configured to obtain the transformed gamma curve according to the grayscale voltage corresponding to the grayscale pixel value N and the grayscale voltage corresponding to the maximum grayscale pixel value $N_{max}$;

a storage module 620, configured to store the transformed gamma curve;

an acquisition module 630, configured to acquire the transformed gamma curve, the transformed gamma curve being a gamma curve obtained by reducing the grayscale voltage in the initial gamma curve according to the preset ratio and the preset ratio being smaller than 1 and more than 0, wherein the module may include: the following modules:

a reading sub-module 630*a*, configured to read, according to the night display level, the transformed gamma curve corresponding to the current night display level, wherein different night display levels correspond to different transformed gamma curves, and different transformed gamma curves correspond to different preset ratios;

a querying module 640, configured to query a corresponding grayscale voltage in the transformed gamma curve according to a grayscale pixel value of a pixel to be displayed; and an output module 650, configured to, at a scanning moment corresponding to the pixel, output the grayscale voltage to a data line corresponding to the pixel in a liquid crystal display screen.

With respect to the devices in the above embodiments, the specific manners for performing operations for individual modules therein have been described in detail in the embodiments regarding the related methods, which will not be elaborated herein.

In view of the above, according to the device for reducing the display brightness in the embodiment, the transformed gamma curve is calculated according to the initial gamma curve and the preset ratio, the transformed gamma curve corresponding to the current night display level is read according to the current night display level, the corresponding grayscale voltage in the transformed gamma curve is queried according to the grayscale pixel value of the pixel to be displayed, and the queried grayscale voltage is output to the data line corresponding to the pixel in the liquid crystal display screen at the scanning moment corresponding to the pixel, so that the problem of incapability in meeting a requirement on ambient light by regulating brightness of a backlight or a background color of a UI in case of extremely dark ambient light is solved, and the effect of reducing the brightness of the screen by reducing the grayscale voltage of the pixel in the liquid crystal display screen in case of extremely dark ambient light is achieved.

Figure 7:
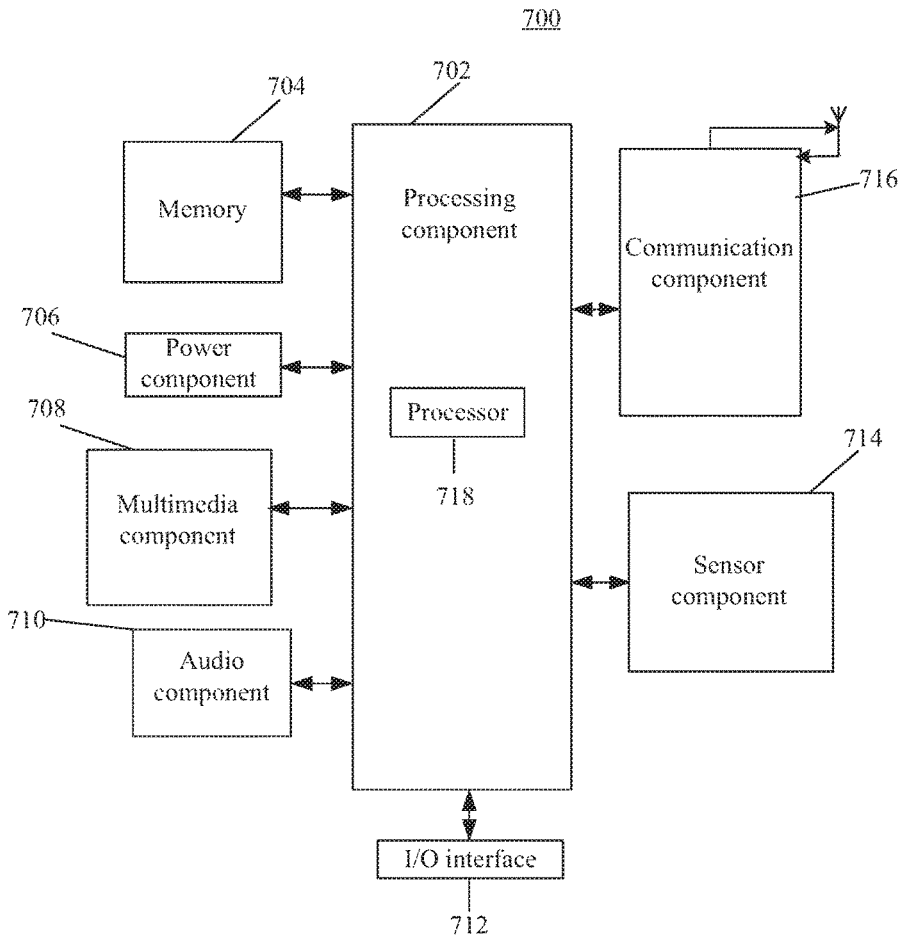
FIG. 7 is a block diagram of a device for reducing display brightness, according to an exemplary embodiment.

FIG. 7 is a block diagram of a device for reducing display brightness, according to an exemplary embodiment. For example, the device 700 may be a mobile phone, a computer, a digital broadcast terminal, a messaging device, a gaming console, a tablet, a medical device, exercise equipment, a personal digital assistant and the like.

Referring to FIG. 7, the device 700 may include one or more of the following components: a processing component 702, a memory 704, a power component 706, a multimedia component 708, an audio component 710, an Input/Output (I/O) interface 712, a sensor component 714, and a communication component 716.

The processing component 702 typically controls overall operations of the device 700, such as the operations associated with display, telephone calls, data communications, camera operations, and recording operations. The processing component 702 may include one or more processors 718 to execute instructions to perform all or part of the steps in the abovementioned methods. Moreover, the processing component 702 may include one or more modules which facilitate interaction between the processing component 702 and the other components. For instance, the processing component 702 may include a multimedia module to facilitate interaction between the multimedia component 708 and the processing component 702.

The memory 704 is configured to store various types of data to support the operation of the device 700. Examples of such data include instructions for any applications or methods operated on the device 700, contact data, phonebook data, messages, pictures, video, etc. The memory 704 may be implemented by any type of volatile or non-volatile memory devices, or a combination thereof, such as a Static Random Access Memory (SRAM), an Electrically Erasable Programmable Read-Only Memory (EEPROM), an Erasable Programmable Read-Only Memory (EPROM), a Programmable Read-Only Memory (PROM), a Read-Only Memo (ROM), a magnetic memory, a flash memory, and a magnetic or optical disk.

The power component 706 provides power for various components of the device 700. The power component 706 may include a power management system, one or more power supplies, and other components associated with the generation, management and distribution of power for the device 700.

The multimedia component 708 includes a screen providing an output interface between the device 700 and the user. In some embodiments, the screen may include an LCD and a Touch Panel (TP). If the screen includes the TP, the screen may be implemented as a touch screen to receive an input signal from the user. The TP includes one or more touch sensors to sense touches, swipes and gestures on the TP. The touch sensors may not only sense a boundary of a touch or swipe action, but also sense a duration and pressure associated with the touch or swipe action. In some embodiments, the multimedia component 708 includes a front camera and/or a rear camera. The front camera and/or the rear camera may receive external multimedia data when the device 700 is in an operation mode, such as a photographing mode or a video mode. Each of the front camera and the rear camera may be a fixed optical lens system or have focusing and optical zooming capabilities.

The audio component 710 is configured to output and/or input an audio signal. For example, the audio component 710 includes a microphone (MIC), and the MIC is configured to receive an external audio signal when the device 700 is in the operation mode, such as a call mode, a recording mode and a voice recognition mode. The received audio signal may be further stored in the memory 704 or sent through the communication component 716. In some embodiments, the audio component 710 further includes a speaker configured to output the audio signal.

The I/O interface 712 provides an interface between the processing component 702 and a peripheral interface module, and the peripheral interface module may be a keyboard, a click wheel, a button and the like. The button may include, but not limited to: a home button, a volume button, a starting button and a locking button.

The sensor component 714 includes one or more sensors configured to provide status assessment in various aspects for the device 700. For instance, the sensor component 714 may detect an on/off status of the device 700 and relative positioning of components, such as a display and small keyboard of the device 700, and the sensor component 714 may further detect a change in a position of the device 700 or a component of the device 700, presence or absence of contact between the user and the device 700, orientation or acceleration/deceleration of the device 700 and a change in temperature of the device 700. The sensor component 714 may include a proximity sensor configured to detect presence of an object nearby without any physical contact. The sensor component 714 may also include a light sensor, such as a Complementary Metal Oxide Semiconductor (CMOS) or Charge Coupled Device (CCD) image sensor, configured for use in an imaging application. In some embodiments, the sensor component 714 may also include an acceleration sensor, a gyroscope sensor, a magnetic sensor, a pressure sensor or a temperature sensor.

The communication component 716 is configured to facilitate wired or wireless communication between the device 700 and another device. The device 700 may access a communication-standard-based wireless network, such as a Wireless Fidelity (WiFi) network, a 2nd-Generation (2G) or 3rd-Generation (3G) network or a combination thereof. In an exemplary embodiment, the communication component 716 receives a broadcast signal or broadcast associated information from an external broadcast management system through a broadcast channel. In an exemplary embodiment, the communication component 716 further includes a Near Field Communication (NFC) module to facilitate short-range communication. For example, the NFC module may be implemented on the basis of a Radio Frequency Identification (RFID) technology, an Infrared Data Association (IrDA) technology, an Ultra-WideBand (UWB) technology, a BlueTooth (BT) technology and another technology.

In the exemplary embodiment, the device 700 may be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors or other electronic components, and is configured to execute the abovementioned methods.

In the exemplary embodiment, there is also provided a non-transitory computer-readable storage medium including an instruction, such as the memory 704 including an instruction, and the instruction may be executed by the processor 718 of the device 700 to implement the abovementioned methods. For example, the non-transitory computer-readable storage medium may be a ROM, a Random Access Memory (RAM), a Compact Disc Read-Only Memory (CD-ROM), a magnetic tape, a floppy disc, an optical data storage device and the like.

Other embodiments of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as conic within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes may be made without departing from the scope thereof. It is intended that the scope of the present disclosure only be limited by the appended claims.

INDUSTRIAL APPLICABILITY

According to the present disclosure, the transformed gamma curve is acquired, the corresponding grayscale voltage in the transformed gamma curve is queried according to the grayscale pixel value of the pixel to be displayed, and the queried grayscale voltage is output to the data line corresponding to the pixel in the liquid crystal display screen at the scanning moment corresponding to the pixel, so that the problem of incapability in meeting the requirement on the ambient light by regulating the brightness of the backlight or a background color of a User Interface (UI) in case of extremely dark ambient light is solved, and the effect of reducing the brightness of the screen by reducing the grayscale voltage of the pixel in the liquid crystal display screen in case of extremely dark ambient light is achieved.

What is claimed is:

1. A method for reducing display brightness, comprising:

acquiring a first corresponding relationship between pixel values and voltages for reducing display brightness, the first corresponding relationship being determined based on a second corresponding relationship between pixel values and voltages and a ratio for brightness reduction, wherein the first corresponding relationship is determined by:

multiplying a maximum pixel value $N_{max}$ by the ratio to obtain a target pixel value $N_x$;

determining a target voltage corresponding to the target pixel value $N_x$ according to the second corresponding relationship;

corresponding the target voltage $V_{max}$ to the maximum pixel value $N_{max}$ in the first corresponding relationship;

determining a brightness value $B_{max}$ corresponding to the target voltage $V_{max}$ according to a brightness-voltage relationship;

calculating a brightness value $B_n$ corresponding to a pixel value N according to a formula:

$$(N/N\text{max})^{\text{gamma value}}=Bn/B\text{max};$$

determining a voltage $V_n$ corresponding to the brightness value $B_n$ according to the brightness-voltage relationship; and corresponding the voltage $V_n$ to the pixel value N in the first corresponding relationship;

storing the first corresponding relationship;

determining a voltage corresponding to a pixel value of a pixel to be displayed based on the first corresponding relationship; and at a scanning moment corresponding to the pixel, outputting the determined voltage to a data line corresponding to the pixel in a liquid crystal display screen.

2. The method according to claim 1, wherein acquiring the first corresponding relationship between the pixel values and the voltages for reducing display brightness comprises:

storing a plurality of first corresponding relationships respectively for a plurality of night display levels, wherein the plurality of first corresponding relationships are determined based on the second corresponding relationship and ratios corresponding to the plurality of night display levels.

3. The method according to claim 2, further comprising:

detecting an ambient light intensity;

determining a night display level based on the ambient light intensity; and selecting the first corresponding relationship from the plurality of first corresponding relationship based on the night display level.

4. The method according to claim 1, wherein the gamma value is in a range from 1.8 to 2.5.

5. A device for reducing display brightness, comprising:

a processor; and a memory configured to store executable instructions of the processor, and store a first corresponding relationship between pixel values and voltages for reducing display brightness, the first corresponding relationship being determined based on a second corresponding relationship between pixel values and voltages and a ratio for brightness reduction, wherein the processor is configured to determine the first corresponding relationship by:

multiplying a maximum pixel value $N_{max}$ by the ratio to obtain a target pixel value $N_x$;

determining a target voltage corresponding to the target pixel value $N_x$ according to the second corresponding relationship;

corresponding the target voltage $V_{max}$ to the maximum pixel value $N_{max}$ in the first corresponding relationship;

determining a brightness value $B_{max}$ corresponding to the target voltage $V_{max}$ according to a brightness-voltage relationship;

calculating a brightness value $B_n$ corresponding to a pixel value N according to a formula:

$$(N/N\text{max})^{\text{gamma value}}=Bn/B\text{max};$$

determining a voltage $V_n$ corresponding to the brightness value $B_n$ according to the brightness-voltage relationship; and corresponding the voltage $V_n$ to the pixel value N in the first corresponding relationship;

wherein the processor is further configured to:

determine a voltage corresponding to a pixel value of a pixel to be displayed based on the first corresponding relationship; and at a scanning moment corresponding to the pixel, output the determined voltage to a data line corresponding to the pixel in a liquid crystal display screen.

6. The device according to claim 5, wherein the memory is configured to store a plurality of first corresponding relationships respectively for a plurality of night display levels, wherein the plurality of first corresponding relationships are determined based on the second corresponding relationship and ratios corresponding to the plurality of night display levels.

7. The device according to claim 6, wherein the processor is configured to:

detect an ambient light intensity;

determine a night display level based on the ambient light intensity; and select the first corresponding relationship from the plurality of first corresponding relationship based on the night display level.

8. The device according to claim 5, wherein the gamma value is in a range from 1.8 to 2.5.

9. A non-transitory computer-readable storage medium having stored therein instructions that, when executed by a processor of a mobile terminal, causes the mobile terminal to perform operations for reducing display brightness, the operations comprising:

reading, from a memory, a first corresponding relationship between pixel values and voltages for reducing display brightness, the first corresponding relationship being determined based on a second corresponding relationship between pixel values and voltages and a ratio and stored in the memory, wherein the first corresponding relationship is determined by:

multiplying a maximum pixel value $N_{max}$ by the ratio to obtain a target pixel value $N_x$;

determining a target voltage corresponding to the target pixel value $N_x$ according to the second corresponding relationship;

corresponding the target voltage $V_{max}$ to the maximum pixel value $N_{max}$ in the first corresponding relationship;

determining a brightness value $B_{max}$ corresponding to the target voltage $V_{max}$ according to a brightness-voltage relationship;

calculating a brightness value $B_n$ corresponding to a pixel value N according to a formula:

$$(N/N\text{max})^{\text{gamma value}}=Bn/B\text{max};$$

determining a voltage $V_n$ corresponding to the brightness value $B_n$ according to the brightness-voltage relationship; and corresponding the voltage $V_n$ to the pixel value N in the first corresponding relationship;

determining a voltage corresponding to a pixel value of a pixel to be displayed based on the first corresponding relationship; and at a scanning moment corresponding to the pixel, outputting the determined voltage to a data line corresponding to the pixel in a liquid crystal display screen.

10. The non-transitory computer-readable storage medium according to claim 9, wherein the operations further comprise:

selecting the first corresponding relationship from a plurality of first corresponding relationships respectively for a plurality of night display levels, wherein the plurality of first corresponding relationships are determined based on the second corresponding relationship and ratios corresponding to the plurality of night display levels.

11. The non-transitory computer-readable storage medium according to claim 10, wherein the operations comprise:

detecting an ambient light intensity;

determining a night display level based on the ambient light intensity; and selecting the first corresponding relationship from the plurality of first corresponding relationship based on the night display level.

12. The non-transitory computer-readable storage medium according to claim 9, wherein the gamma value is in a range from 1.8 to 2.5.

* * * * *